United States Patent [19]

Balz

[11] Patent Number: 4,499,692

[45] Date of Patent: Feb. 19, 1985

[54] DUAL MOTION VIBRATORY FINISHING MACHINE AND METHOD

[75] Inventor: Gunther W. Balz, Kalamazoo, Mich.

[73] Assignee: Roto-Finish Company, Inc., Kalamazoo, Mich.

[21] Appl. No.: 389,005

[22] Filed: Jun. 16, 1982

[51] Int. Cl.[3] ..... B24B 1/00

[52] U.S. Cl. ..... 51/313; 51/163.1

[58] Field of Search ..... 51/163.1, 163.2, 313-316; 366/108, 114; 241/30, 175

[56] References Cited

U.S. PATENT DOCUMENTS

| | | | |
|---|---|---|---|
| 3,624,970 | 12/1971 | Balz | 51/163.1 |
| 4,380,137 | 4/1983 | Balz | 51/163.1 |
| 4,402,162 | 9/1983 | Kobayashi | 51/163.2 |

FOREIGN PATENT DOCUMENTS

| | | | |
|---|---|---|---|
| 469580 | 7/1975 | U.S.S.R. | 51/163.1 |

*Primary Examiner*—Frederick R. Schmidt
*Assistant Examiner*—Matthew D. Daschel
*Attorney, Agent, or Firm*—Gordon W. Hueschen

[57] ABSTRACT

A method for the surface finishing of a part or workpiece with loose particulate finishing material or media comprising the steps of providing a first body of finishing media, providing a second body of finishing media, said first body and said second body being in side-by-side juxtaposition with respect to each other, independently imparting vibratory action to each of said first and second bodies of finishing media to impart relative motion to the particular segments thereof and to cause portions of said first and second bodies to impinge upon each other, and subjecting the part or workpiece to the action of said finishing media for the surface finishing of said part or workpiece while said finishing media is in motion, preferably by fixturing said part or workpiece and passing said part or workpiece through the finishing media, and preferably wherein orbital motion is imparted to each of the said bodies of finishing media, especially orbital motion which is other than unidirectional, particularly when the orbital motion imparted to said first body of finishing media is a generally clockwise orbital motion and the orbital motion imparted to said second body of finishing media is a generally counterclockwise orbital motion, the part to be finished preferably being subjected to the action of the finishing media in the area of the confluence of said orbits or rolls, and a finishing machine particularly adapted for the carrying out of the said method, are disclosed.

33 Claims, 6 Drawing Figures

DUAL MOTION VIBRATORY FINISHING MACHINE AND METHOD

BACKGROUND OF THE INVENTION

1. Field of the Invention

Surface finishing of parts or workpieces and finishing machines and apparatus for the carrying out of such surface-finishing procedure therein.

2. Prior Art

Innumerable methods for the surface finishing of parts and/or workpieces, especially with the employment of finishing media comprising loose or particulate segments, and apparatus particularly adapted for the carrying out of particular surface-finishing methods therein, have been provided since the outset of this area of technology between forty and fifty years ago. Although great strides have been made in this technology to date, certain areas leave much room for improvement. For example, in the area of vibratory finishing methods and apparatus, it would be highly desirable to have an additional method whereby the action of the finished material or media upon the part or workpiece to be finished could be varied from extremely gentle to extremely harsh, depending upon the type of part or workpiece being finished and the desires of the operator. It would also be highly desirable to have available a surface finishing method wherein the type of action imparted to the part or workpiece within the finishing chamber could be subjected to wide variations and wherein the different operating modes could be effected without undue convenience. It would be especially desirable to have available a surface finishing method wherein and whereby extremely fragile parts, such as sand cores and the like, could be subjected to the action of finishing media for removal of flash, burrs, and other surface imperfections without at the same time inflicting undesired alterations in the surface characteristics and contours of the part or workpiece being finished which remove them from the area of utilizability due to departure from established specifications. It would also be highly desirable to have available such a surface-finishing method which could be rapidly and conveniently employed for a finishing cycle of extremely short duration as well as for a prolonged duration, depending upon the type of part or workpiece to be finished and the degree of surface finishing desired by the operator. It follows that it would also be highly desirable to have available a novel surface-finishing machine or apparatus particularly adapted for the carrying out of such an improved surface-finishing method therein.

Such surface-finishing method and finishing machines or apparatus particularly adapted for the carrying out of such method therein have not heretofore been available in the prior art, but are now made available by the present invention which involves novel concepts of individual bodies of finishing media located in side-by-side juxtaposition to each other and the independent importation of vibratory action thereto for purposes of attaining hitherto unattainable movement, action, orbital motion, mixtures of orbital motions, and confluence of orbital motions within the finishing method, and which moreover provides unique finishing apparatus which is especially adapted for the application of such novel concepts and the carrying out of such novel surface-finishing method therein.

OBJECTS OF THE INVENTION

It is an object of the present invention to provide a novel method for the surface finishing of parts or workpieces with loose particulate finishing material or media wherein two bodies of finishing media are arranged in side-by-side juxtaposition with respect to each other, independently vibrated to impart relative motion to the particulate segments of the finishing media and to cause portions of the bodies of finishing material to impinge upon each other, and wherein the part or workpiece is subjected to the action of said finishing media while said finishing media is in motion. A further object is to provide such a method wherein orbital motion can be imparted to each of said bodies of finishing media, and especially wherein said orbital motion is other than unidirectional, particularly wherein orbital motion imparted to the first body of finishing media is generally clockwise and the orbital motion imparted to the second body of finishing media is generally counterclockwise. Another object of the invention is the provision of such a method wherein the independent application of vibratory action to each of the said bodies of finishing media allows a great variety of variations to be imparted to the finishing media within the finishing chamber and within the separate sections of the finishing chamber wherein said separate bodies of finishing media are located. An additional object of the invention is to provide such a method whereby the type of action imparted to a part or workpiece being finished can be greatly controlled and varied, depending upon the individual characteristics of the part or workpiece to be finished. A still further object of the invention is to provide such a method wherein the vibratory action imparted to the finishing media and hence to the part or workpiece being finished may be varied from extremely gentle to extremely violent. Still an additional object of the invention is the provision of such a method wherein a part or workpiece may be fixtured to be subjected to the action of the finishing media and, if desired, may be passed through said finishing media. A particular object of the invention is to provide such a method wherein a part or workpiece may be fixtured and subjected to the action of the finishing media in an area of convergence of counterclockwise and clockwise orbital motions of individual finishing media. Still another object of the invention is the provision of a finishing machine or apparatus which is particularly adaptable for the carrying out the method of the present invention therein. Yet an additional object of the invention is the provision of such a method and apparatus which avoids inherent disadvantages of prior art methods and apparatus and which are characterized by certain definite advantages and superiority thereover due to the unique characteristics thereof. Further objects will be apparent to one skilled in the art and still other objects will become apparent hereinafter.

SUMMARY OF THE INVENTION

The objects of this invention are attained by provision of a method for the surface finishing of a part or workpiece with loose particulate finishing material of media comprising the steps of providing a first body of finished media, providing a second body of finishing media, said first body and said second body being in side-by-side juxtaposition with respect to each other, independently applying vibratory action to each of said first and second bodies of finishing media to impart relative motion to the particulate segments thereof and to cause portions of said first and second bodies to impinge upon each other, and subjecting the part or workpiece to the action of said finishing media for the surface finishing of said part or workpiece by the action of said finishing media; such method wherein orbital motion is imparted to each of said bodies of finishing media; such method wherein the orbital motion imparted to said bodies of finishing material is other than unidirectional; such method wherein the orbital motion imparted to said first body of finishing media is a generally clockwise orbital motion and wherein the orbital motion imparted to said second body of finishing media is a generally counter-clockwise orbital motion, especially wherein the clockwise motion or roll is on the left-hand side and the counter-clockwise motion or roll is on the right-hand side; such method wherein said part or workpiece is fixtured during subjection of said part or workpiece to the action of said finishing media; such method wherein said part or workpiece is passed through said finishing media; and such method wherein said part or workpiece is fixtured and subjected to the action of said finishing media in the area of convergence of said counter-clockwise and said clockwise orbital motions of said media.

The objects of the present invention are also accomplished by the provision of an apparatus or machine, for finishing the surface of workpieces by attrition with a finishing media of loose or particulate nature, which includes a finishing chamber comprising two independent upwardly-extending finishing chamber walls, said walls being in apposed facing relation with respect to each other, resilient means for resiliently associating said walls with each other at a bottom portion thereof, and vibratory means independently associated with each of said two finishing chamber walls for independently imparting vibratory motion thereto; such machine wherein said finishing chamber is resiliently supported for vibration; such machine wherein each of said upwardly-extending walls is essentially arcuate in cross-section; such machine wherein said arcuate cross-section is essentially that of a semi-circle or portion thereof; such machine wherein said vibratory means on each of said walls is variable to vary the vibrations imparted to each of said walls and to loose or particulate finishing media within said finishing chamber; such machine wherein each of said walls defines a separate section of said finishing chamber, the two apposed walls defining two side-by-side juxtaposed sections of said finishing chamber, and wherein the vibratory means associated with each of said walls is adapted to impart vibrations to the section of said finishing chamber defined by the wall with which it is associated; such machine wherein said vibratory means is adapted to impart either unidirectional or other than unidirectional orbital motion to finishing media within said finishing chamber; such machine wherein said vibratory means is adapted to impart clockwise orbital motion to finishing media within said first section of said finishing chamber and counterclockwise orbital motion to finishing media within said second section of said finishing chamber; such machine wherein said walls are resiliently connected with each other by connecting means at a bottom portion thereof; such machine wherein said connecting means is elastomeric; such machine also comprising an elastomeric lining on the inner surfaces of the finishing chamber thereof; such machine wherein both said connecting means and said interior finishing chamber lining are elastomeric; such machine wherein said connector and said interior lining provide an essentially integral elastomeric surface interior of said finishing chamber; such machine including also, in association therewith, fixture means for fixturing a part or workpiece within said finishing chamber for action thereupon of finishing media therein; such machine wherein said fixture means comprises a track and carriage means suspended therefrom for fixturing of parts or workpieces for passage through said finishing chamber for subjecting said part or workpieces to the action of finishing media therein; such machine wherein a plurality of said finishing chamber units are connected linearly; such machine wherein said finishing machine comprises a plurality of individual finishing chamber units arcuately connected; such machine wherein said finishing machine comprises a plurality of individual finishing chamber units arcuately connected so as to form a circle; such machine wherein said plurality of individual finishing chamber units are independently mounted and resiliently connected; and such machine wherein said walls and said associating resilient means cooperate to form not only resiliently-associated upwardly-extending walls but also the bottom of said finishing chamber.

Finally, in its broadest sense, the objects of the invention are attained by provision of a finishing machine for the finishing of parts or workpieces therein by the action of loose or particulate finishing material or media therein, including a finishing chamber comprising two independent finishing chamber sections, said sections being resiliently associated with each other at a bottom portion of said finishing chamber, and vibratory means independently associated with each of said two finishing chamber sections for independently imparting vibratory motion thereto; a method for the surface finishing of a part or workpiece with loose particulate finishing material or media comprising the steps of providing a body of finishing media, applying vibratory action to said body of finishing media to impart relative motion to the particulate segments thereof and to cause orbital motion to be imparted to said body of finishing media, fixturing said part or workpiece with relation to a particular peripheral upward or downward segment of said orbital flow, and subjecting said part or workpiece to the action of said finishing media for the surface finishing of said part or workpiece, particularly at a surface portion thereof impinged upon by the said upward or downward action of said finishing media at said particular peripheral segment of said orbital flow; such method wherein the orbital motion imparted to said body of finishing material is a clockwise orbital motion and wherein said part or workpiece is fixtured with respect to a downward segment of said orbital flow for subjecting said part or workpiece to the action of said finishing media essentially at a top portion thereof; such method wherein the orbital motion imparted to said body of finishing material is a counterclockwise orbital motion and wherein said part or workpiece is fixtured with respect to a downward segment of said orbital flow for subjecting said part or workpiece to the action of said finishing media essentially at a top portion thereof; such method wherein the orbital motion imparted to said body of finishing material is a clockwise orbital motion and wherein said part or workpiece is fixtured with respect to an upward segment of said orbital flow for subjecting said part or workpiece to the action of said finishing media essentially at a bottom portion thereof; such method wherein the orbital motion imparted to said body of finishing material is a counterclockwise orbital motion and wherein said part or workpiece is fixtured with respect to an upward segment of said orbital flow for subjecting said part or workpiece to the action of said finishing media essentially at a bottom portion thereof; such method wherein two separate bodies of finishing media are provided and each is vibrated independently with respect to the other to produce orbital motion therein, said orbital motion in the one body being counterclockwise and in the other body being clockwise, and subjecting said part or workpiece to the action of said finishing media in approximately the area of confluence or convergence of said two orbital motions of said two bodies of finishing media.

BRIEF DESCRIPTION OF THE DRAWINGS

The invention will now be described with particular reference to the drawings, in which.

SPECIFIC REFERENCE TO THE DRAWINGS

Reference is now made to the accompanying drawings for a better understanding of the invention, wherein all the essential parts are numbered and wherein the same numbers are used to refer to corresponding parts throughout unless otherwise indicated.

Figure 1:
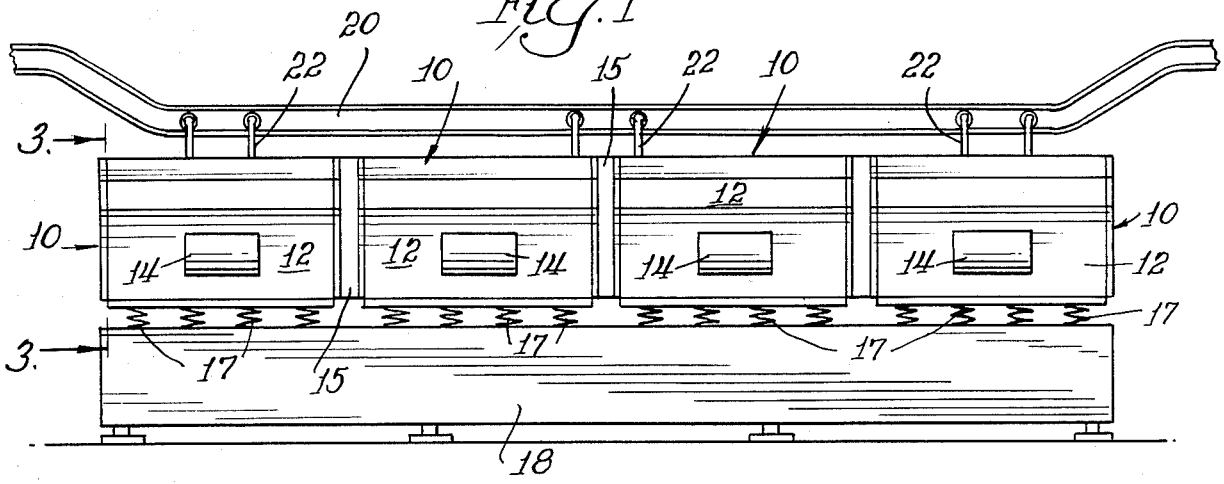
FIG. 1 is a side elevation of a finishing machine according to the invention comprising a plurality of finishing machine units connected by boots and having an overhead track for carrying parts or workpieces into or through one or more of the individual finishing machine units.
Figure 2:
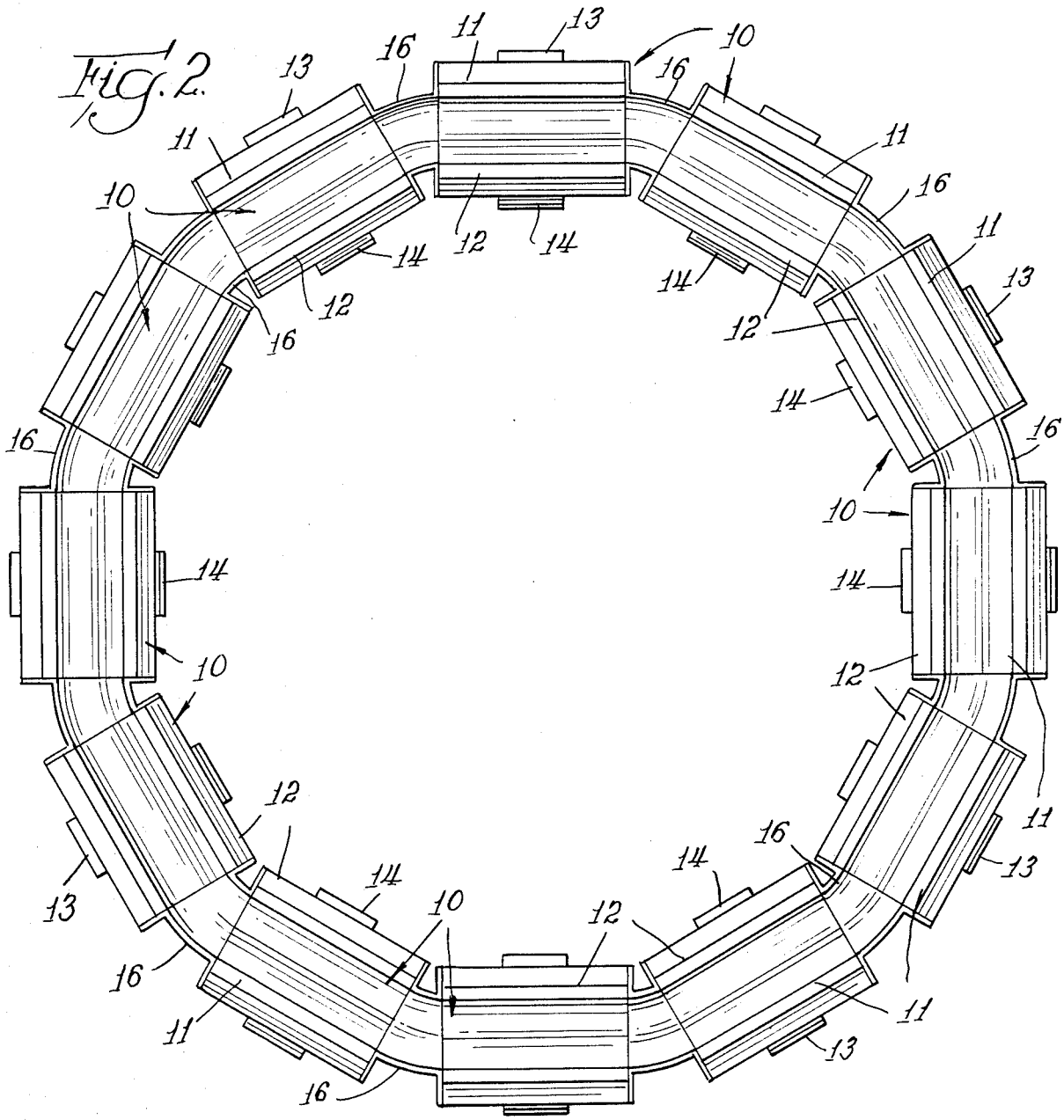
FIG. 2 is a top plan view of a plurality of finishing machine units arranged in a circle and connected by wedge-shaped connecting boots.
Figure 4:
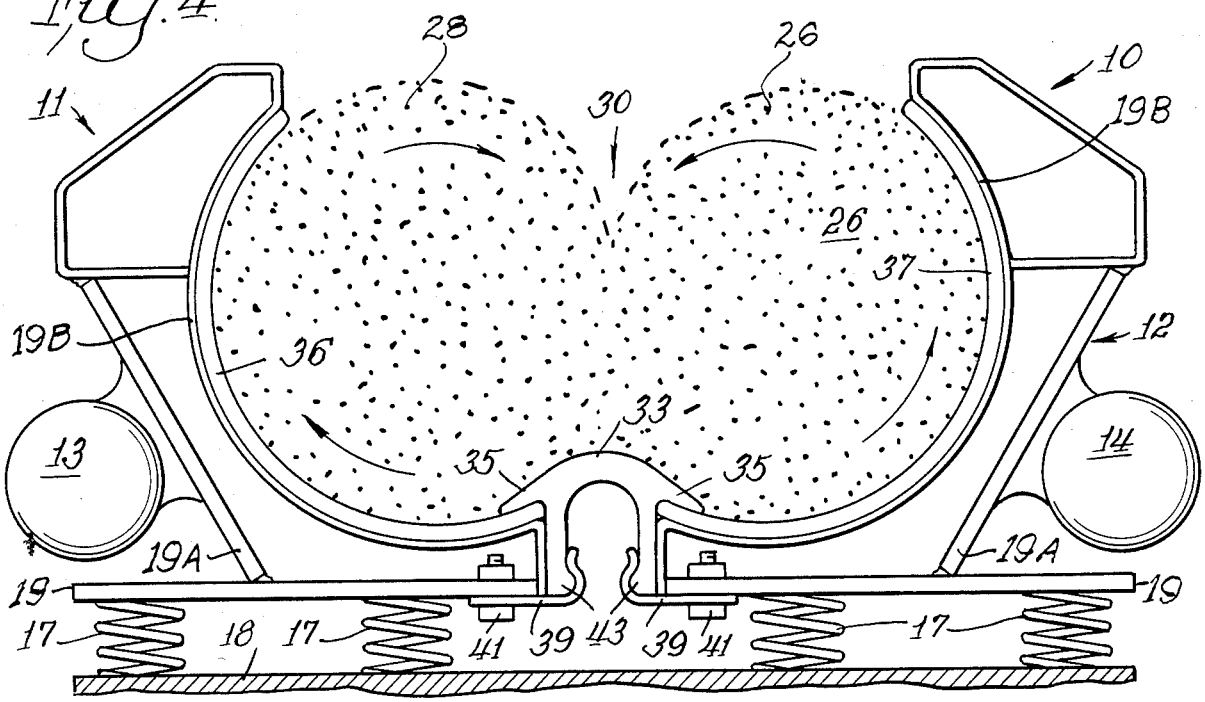
FIG. 4 is an end view of another type of finishing machine unit according to the invention, again without end plate or with end plate removed.
Figure 5:
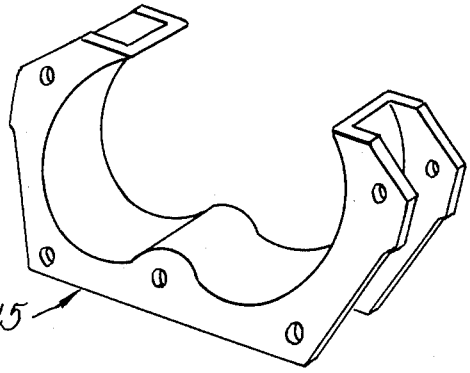
FIG. 5 is a perspective view of a connecting boot for joining a plurality of finishing machine units linearly as shown in FIG. 1.

In a preferred multiple-unit form, the finishing apparatus of the invention is shown in FIG. 1. An annular version is shown in FIG. 2. End views of particular specific types of finishing machine units are shown in FIGS. 3 and 4, and ancilliary connecting means, utilizable for the connection of a plurality of units in series as shown by FIG. 1 or FIG. 2, are exemplified in FIGS. 5 and 6.

The individual vibratory finishing machine units according to the invention are generally shown at 10 and have segmented halves 11 and 12. As shown, the segmentation divides the finishing chambers of the individual finishing machine units into identical halves.

Figure 3:
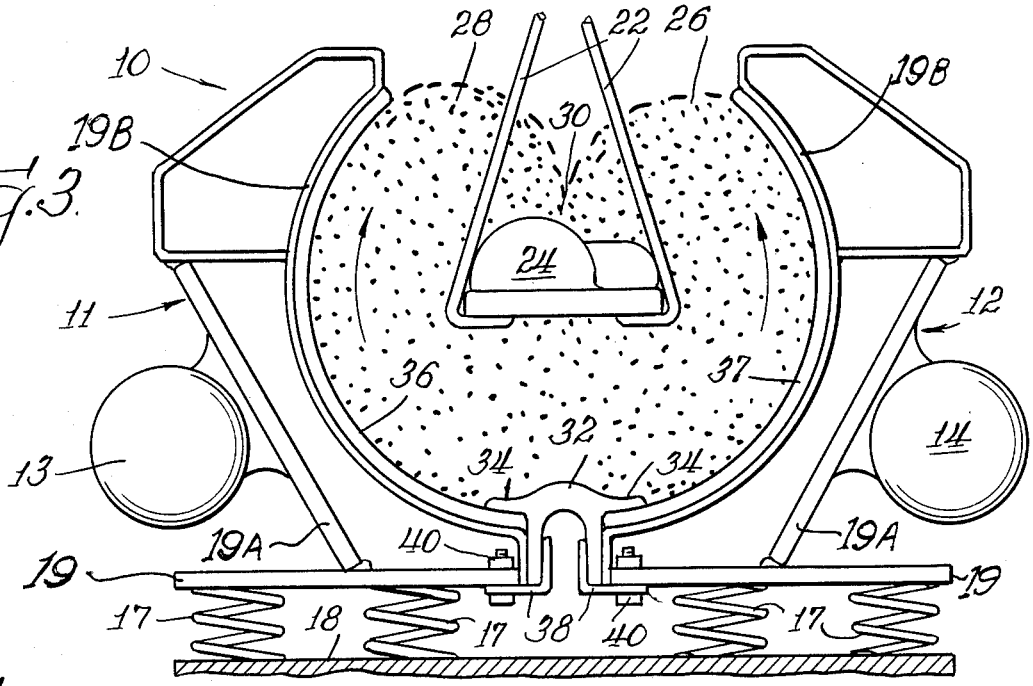
FIG. 3 is an end view of one type of finishing machine unit according to the invention, without an end plate or with end plate removed.

As shown in FIGS. 1-3, the surface-finishing machine comprises a base or stand 18, resilient supporting members 17, as shown in the form of springs, individual halves 11 and 12, each half having its own vibratory unit, i.e., vibratory motors 13 and 14 respectively associated with respective finishing chamber halves 11 and 12.

As shown in FIG. 1, the individual vibratory finishing-machine units are connected by connecting boots 15, which may be of any suitable elastomeric or resilient material to allow independent movement of the individual finishing machine units. For finishing parts or workpieces within the individual finishing machine units or a plurality thereof, the part or workpiece may be suspended upon carriage 22 movably mounted in an overhead track 20, as shown in FIG. 1 mounted generally horizontally above a plurality of individual finishing machine units 10, four of which are shown linearly connected in series.

In FIG. 2, the individual finishing machine units are connected arcuately in series and take an annular form, i.e., that of a circle. The connecting boots 16 in this case are wedge-shaped for purpose of effecting the desired arcuate segmentation and connection. The overhead track and suspended carriage, respectively 20 and 22, which could be either linear or circular in the case of the arrangement of FIG. 2, is not shown in FIG. 2. Of course, the overhead track 20, for employment with the arrangement of FIG. 2, could be either completely or partially annular or a plurality of straight tracks, as will be apparent to one skilled in the art, depending upon whether it is desired to subject a part or workpiece suspended thereby to the surface-finishing action of finishing media in one or more of the individual finishing machine units or in all of them.

FIG. 3 shows an end view of one of the individual finishing machine units 10 of FIG. 1 with end plate removed, and is taken along the line 3—3 of FIG. 1.

As shown in FIGS. 3 and 4, the end plate of an individual finishing machine unit has been removed or is non-existent. When the finishing machine unit constitutes the first or last unit in a series, as shown in FIG. 1, then the end plate, as indicated in FIG. 1, is usually coextensive in area with the outer contour of the finishing machine unit as shown in end view in FIGS. 3 and 4. However, when the individual finishing machine unit comprises an interior unit of a multi-unit device, as shown in FIG. 1, or has one end thereof other than at an end or beginning of such a multi-unit device, also as shown in FIG. 1, the end plate on an individual unit will only partially cover the finishing chamber of an individual finishing machine unit, if at all and, when none is present, the end view of an individual finishing machine unit will be exactly as shown in FIGS. 3 and 4. The exact dimensions of end plates which may be employed at the beginning and end of a multiple-unit device, or for any individual finishing machine unit, are not of the essence of the invention and may be varied according to the skill of the art depending upon the desires of the individual operator, that is, whether he desires precession of finishing media and parts or workpieces from one finishing machine unit to another or whether he desires the finishing media and parts in one unit to partially or entirely remain within an individual finishing machine unit, where multiple-unit devices are involved. Minimum end plates are approximately as defined by exterior walls 19A, interior walls 19B, and base plate 19. Of course, where a single finishing machine unit is involved, then complete end plates are usual and also usually employed according to the present invention, as will be apparent to one skilled in the art, and these end plates will in general have an area exhibited in the end views of FIGS. 3 and 4, extending entirely across the finishing chamber and generally from right-hand external wall 19A to left-hand external wall 19A. Partial end plates may have any area in between minimum and complete.

From FIG. 3 are seen base of stand 18, resilient mounting members 17 in the form of springs, but which alternatively can take the form of rubber or other elastomeric mounts, support plates 19, outer wall 19A, and inner wall 19B, the said outer wall 19A being rigidly connected with base plate 19 by welding or the like. Interior wall 19B is lined with polyurethane or other elastomeric material 36,37 and the two upwardly-extending finishing chamber wall sections 11 and 12, each with its own interior arcuate wall 19B, are resiliently associated at their bottom portions by connector 32 of resilient material such as an elastomer, rubber, or the like, having lips 34 overlapping and preferably secured to the interior elastomeric lining 36,37 in their respective areas on the interior walls of the finishing chamber. In this manner, the combination of the connector 32 and the interior elastomeric lining 36,37 provides an essentially integral elastomeric surface interior of the finishing chamber. As shown in FIG. 3, interior walls 19B are flanged at their lower portion and, together with vertically-extending portions of connector 32, are firmly but resiliently secured to base plate 19 by retainers 38, which are in turn secured rigidly to base plate 19 by means of nuts and bolts 40.

As shown in FIG. 3 also, the loose or particulate finishing media 28 on the left side of the finishing chamber lies in juxtaposition to the mass or body of finishing media 26 on the right side of the finishing chamber, and each body or mass is caused to move in an orbital or semiorbital manner in a direction which is opposite to that of the direction of rotation of its individual vibratory motor. Accordingly, with vibratory motor 13 set to move in a counterclockwise direction, mass or body of finishing media 28 moves in a clockwise direction. Conversely, with vibratory motor 14 set to move in a clockwise direction, the body of finishing media 26 moves in a counterclockwise direction. Portions of these two bodies impinge upon each other in the area of confluence or convergence 30, in which area part or workpiece 24, supported by carriage 22, is subjected to the action of the finishing media, such action in the embodiment shown coming from and being mostly on the top surface of the part or workpiece 24 being finished.

Figure 6:
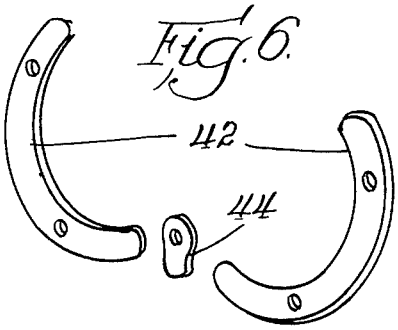
FIG. 6 is a perspective view of suitable metal backup pieces for connecting the connecting boot to individual finishing machine units.

For the alignment of a plurality of such individual finishing machine units in the manner illustrated in FIG. 1, boomerang-shaped auxiliary pieces 42 may be employed for attaching the boot 15 to end plates (not shown) of the individual finishing chamber units, these boomerang-shaped pieces being shown in FIG. 6 together with eyelet piece 44 for connecting the center of boot 15 to connector 32 or 34. The openings shown in the boot 15 and in the corresponding attaching pieces 42 and 44 are for the insertion of bolts to be employed with nuts for the securement of boots 15 to end walls or partial end walls (not shown) of the individual finishing chamber units. Of course, when an arcuate or circular arrangement such as shown in FIG. 2 is desired, the same accouterments as shown in FIG. 6 are employed, but together with the wedge-shaped boot 16 of FIG. 2.

In FIG. 4 is shown a preferred embodiment of the invention, wherein the upwardly-extending walls of the finishing chamber segments 19B are more nearly of a semicircular nature so that the body of finishing media in each of the equal halves of the finishing chamber can more nearly approximate a circular orbital motion when the device is in operation. As is apparent from FIGS. 3 and 4, the said upwardly-extending walls 19B and the connector 32,33 cooperate to form not only resiliently-associated upwardly-extending walls, but also comprise or constitute the bottoms of the finishing chambers of the individual finishing machine units. As shown in FIG. 4, connector 33 has lips 35 and, together with elastomeric lining 36,37 of the interior upwardly-extending walls 19B of said finishing chamber, again presents an essentially integral elastomeric surface interior of said finishing chamber. Said lips 35 may be and preferably are secured to said elastomeric lining 36,37 by adhesive, heat-fusion, or in any other suitable manner.

Also as shown in FIG. 4, the downwardly-extending flanges at the lower ends of upwardly-extending finishing chamber walls 19B, together with downwardly-extending arms of connector 33, in this case provided with beads 43, are firmly but resiliently, due to resilient connector 33, secured to base plate 19 by means of encircling retainers 39,39 and associated nuts and bolts 41. As shown in FIG. 4, with vibratory unit 13 operating in counterclockwise manner, body of finishing media 28 assumes a clockwise orbital motion whereas, with vibratory unit 14 operating in clockwise manner, body of finishing media 28 assumes a counterclockwise orbital motion. The area of their confluence or convergence, at which portions of said media bodies impinge upon each other, is again indicated at 30. Subjection of a part or workpiece to the finishing media within this particular finishing chamber is effected in the same manner as previously discussed with respect to FIG. 3, but in addition parts or workpieces may simply be introduced into the finishing chamber and allowed to move freely therein, in which case there is no interior or central column or second side wall upon which said parts or workpieces must impinge during the surface-finishing process. This is highly advantageous inasmuch as it removes at least one point of unnecessary contact of the part or workpiece which is present in most annular-bowl type finishing machines and in linear finishing machines as well.

Of course, operation of the vibratory unit 14 in counterclockwise manner imparts a clockwise rotation to the the body of finishing media 28, thereby providing an entirely different finishing mode to the machine and to the finishing media in motion within the finishing chamber thereof.

It should likewise be obvious to one skilled in the art that, although the vibratory units have been shown as vibratory motors, any other similar or equivalent means for vibrating the upwardly-extending walls of the finishing chamber can be employed. Moreover, these independent vibratory motors can be run independently at the same or different speeds and amplitudes, as well as direction of rotation, with the eccentric weights at the ends of their shafts being set either in or out of phase, and thus the finishing machine and method and the finishing media within the chamber will all assume different modes in accord with the various settings of the vibratory motors or other vibratory means on the apposed upstanding walls, thus making possible the production of innumerable relative settings and the importation of innumerable different operating modes to the apparatus of the invention and to the finishing media therein. In particular, it should be noted that the media can as usual be caused to precess in one direction or the other by the out-of-phase setting of the usual eccentric weights at the opposite ends of the shaft of the vibratory motor, not shown because they are conventional in this art, in which case for maximum precession it will be clear that the two vibratory motors on the apposed upwardly-extending walls of the finishing chamber should have approximately the same angular setting although it is not essential that they rotate in the same direction. This aspect of the methodology and apparatus of the present invention is so well established in the prior art that it, and the corresponding effect upon the finished media within the finishing chamber, needs no further explanation.

It should also be pointed out that the connector can be of any suitable material of an elastomeric or other nature which provides resiliency and thereby a resilient association between the lower portions of the upwardly-extending finishing chamber walls 19B at the lower ends thereof and that, further, any resilient connection can be employed so long as the upwardly-extending side wall of the finishing chamber can be vibrated independently of its opposite member, each with its own separate vibratory means.

Although as shown in the drawings the vibratory means can be mounted on the side of the upwardly-extending wall of the finishing chamber, it should be apparent to one skilled in the art that the vibratory means can be mounted on said wall at any suitable or desired location, including higher up on the wall or lower down on the wall, including such mounting on a bottom-forming portion of the wall constituting a part of the bottom of the finishing chamber, provided only that in such case the resilient means 17 are lengthened or clearance otherwise provided to permit such bottom-mounting of the same.

The operation of the method of the invention and the finishing machine of the invention have already been described, but the following specific examples of their operation are now given for purposes of illustration only without any intention that they be construed as limiting.

EXAMPLE 1

In operation, sand cores intended for use in the cast—of engine blocks are subjected to a surface-finishing procedure in a single-pass single finishing machine unit according to the invention and substantially as shown in FIG. 4, using either C-2 clay-porcelain bonded finishing media in the form of triangles of approximately one-quarter inch on a side and one-quarter inch thick, or employing wood pegs as the finishing media, or in another case in a succession of finishing operations employing first the C-2 ceramic media and then the wood pegs.

In all of the finishing operations employing the aforesaid media, suspension of the rough sand cores within the selected finishing media at approximately the area of confluence or convergence of the orbital motion of the two bodies of finishing media, as shown in FIG. 4, removes all flash and surface imperfections and brings the sand core into accord with predetermined specifications, the finishing cycle being approximately thirty (30) seconds per sand core per finishing operation.

EXAMPLE 2

According to the method of the present invention and employing a finishing machine in accord with FIG. 1, brass lock parts are subjected to a finishing treatment with steel burnishing balls as the finishing media. In the first finishing chamber, the vibratory units are set so as to provide a clockwise roll or orbital motion in the one body of finishing media and a counterclockwise roll or orbital motion in the adjacent body of finishing media. In the second finishing unit, the vibratory means are set to provide a clockwise rotation in both bodies of media. In the third finishing machine unit, the vibratory means are set to provide a counterclockwise roll or orbital motion in both bodies of finishing media. In the final finishing machine unit, the left-hand body of media is imparted a counterclockwise roll and the right-hand body of media is imparted a clockwise roll. In each of the separate finishing machine units, the vibratory means on the apposed facing upwardly-extending walls of the finishing chamber are set with the same weights and at the same amplitude and the weights are set in phase or minimally out of phase.

At the completion of the finishing operation, the brass lock parts are examined and found to have an extremely bright and burnished surface, and an absolute minimum of surface imperfections, despite the fact that the parts are not fixtured during passage through the finishing machine and the four independent units thereof.

In another similar operation employing belt buckles as the part or workpiece to be finished, and with an increased out-of-phase setting of each of the vibratory units, the settings on the vibratory units on the apposed facing upwardly-extending walls of the finishing chamber being substantially identical, the same result is achieved, but the rate of precession of the parts from the first unit to the last unit is considerably more rapid and the finishing time in each of the finishing machine units is accordingly reduced.

EXAMPLE 3

In a further finishing operation employing the method of the present invention and utilizing the apparatus of FIG. 1, carburetors are fixtured and passed through the individual finishing machine units by means of the carriage and overhead track. The finishing media employed is C-6 fired clay-bonded aluminum oxide-containing chips, the aluminum oxide serving as abrasive therein. The operation is conducted in the same manner as given in Example 2, first part, and the finished products are found to be free of all flash and surface imperfections and burrs and to meet previously-determined specifications. In this case, as in the case of the sand cores of Example 1, it is found that the preferred operating mode is that employed in Example 1, namely, a setting of the vibratory means so as to provide a clockwise rotation or roll of the left-hand body of media and a counterclockwise roll or orbital motion in the right-hand body of finishing media, with the part to be finished being passed through the vibratorily moving finishing media in the area of convergence or confluence of said counterclockwise and said clockwise orbital motions of said media.

EXAMPLE 4

According to the method of the present invention and employing a finishing machine in accord with FIG. 1, carburetor housings are subjected to a finishing treatment with the C-2 clay-porcelain bonded finishing media employed in Example 1. In the first finishing unit, the vibratory units are again set so as to provide a clockwise roll or orbital motion in the one body of finishing media and a counterclockwise roll or orbital motion in the adjacent body of finishing media. In the second finishing machine unit, the vibratory means are set to provide a clockwise rotation in both bodies of media. In the third finishing machine unit, the vibratory means are set to provide a counterclockwise roll or orbital motion in both bodies of finishing media and, in the final finishing machine unit, the vibratory means are set to provide the opposite effect as in the first finishing chamber unit, that is, the left-hand body of media is imparted a counterclockwise roll and the right-hand body of media is imparted a clockwise roll. Again, in each of the separate finishing machine units, the vibratory means on the apposed facing upwardly-extending walls of the finishing chamber are set with the same weights and at the same amplitude and the weights are set in-phase or minimally out-of-phase. The carburetor parts are fixtured and passed through the finishing machine mounted on the carriage suspended from the overhead track, and they are so fixtured as to be in fixed relation to a particular peripheral upward or downward segment of the orbital flow. The carburetor parts are then subjected to the action of the finishing media for the surface finishing of the part or workpiece, particularly at a surface portion thereof which is impinged upon by the said upward or downward action of said finishing media at said particular peripheral segment of said orbital flow. Thus, in the first chamber, the carburetor parts are subjected to the treatment in the area of the confluence or convergence of the orbital flow, being clockwise on the left-hand side and counter clockwise on the right-hand side, the top portion thereof and the left side being particularly impinged upon and finished by the left-hand clockwise roll or orbital flow of the finishing media and the top portion and the right-hand side surface thereof being particularly impinged upon and finished by the downward flow of the counterclockwise right-hand orbital roll. In the second finishing machine unit, the left side and top are finished due to the continued clockwise orbital flow of the finishing media, whereas the bottom and right-hand side are particularly finished by the upward and clockwise rotation of the right-hand body of media. In the third finishing machine unit, the effect is exactly the reverse as that in the second finishing machine unit, namely, the right-hand top surface and right side are finished due to impingement of the finishing media at the peripheral downward segment of the counterclockwise orbital motion in the right-hand body of media, whereas the bottom and left side are subjected to the peripheral upward motion of the orbital flow in a counterclockwise direction in the left-hand body of finishing media. Finally, in the last finishing machine unit, the left-hand body of media impinges upon the part at the bottom and left side due to the peripheral upward flow of the left-hand body of media undergoing a counterclockwise orbital motion, whereas the bottom and right side of the carburetor part is impinged upon by the upward peripheral segment of the clockwise orbital flow imparted to the right-hand body of finishing media undergoing a clockwise roll or orbital motion. The ultimate result is removal of all flash and surface imperfections and bringing of the carburetor part into complete accord with predetermined specifications in a total finishing time not exceeding twenty minutes.

Although the cross-section of the finishing chamber wall has been described here as being arcuate or essentially arcuate, and particularly and preferably as being a cross-section essentially that of a semi-circle or portion thereof, it is to be understood that it is not essential that such upwardly-extending or defining wall of the finishing chamber be arcuate or semi-circular in the precise sense of the term. It is only necessary that it be generally arcuate or semi-circular, that is, insufficiently cornered so as to prevent the free flow of finishing media and parts to be finished, when said parts are not fixtured therein, in and around the interior of the particular section of the finishing chamber involved and of the finishing chamber in general. For example, the upwardly-extending walls of the individual sections of the individual sections of the finishing chamber may be, when they are generally arcuate or semi-circular in cross-section, decagonal, octagonal, hexagonal, or pentagonal, or may have any other somewhat cornered cross-section which does not detract from the general arcuate or semi-circular nature or interfere with the flow of parts and media, when said parts are not fixture or suspended therein, within the interior of a particular finishing chamber section or in the finishing chamber in general. Although, for purposes of ultimate convenience and operating efficiency, a truly arcuate or semi-circular cross-section is preferred, other generally arcuate and generally semi-circular cross-sections may be imparted to the upwardly-extending walls of the finishing chamber with equal or only somewhat reduced efficiency, as will be apparent to one skilled in the art.

It is to be understood that the term "finishing media" is used generally herein to designate materials used to impart all types of finishes, including those finishes acquired with abrading material as well as with polishing material, and that polishing, abrading, deburring, edgebreaking, buffing, burnishing, and the like, are as usual only species of finishing. The term "finishing media", as used herein, is also intended to include all such materials which serve as loose, particulate, and solid finishing materials of the type presently employed in the trade and others of a similar nature whether natural or synthetic, including stone, porcelain, abrasive-filled clays, plastics, ceramics, wood, leather, or the like, and in any suitable shape or form as may be employed for the surface refinement and/or deburring of parts or workpieces, which are usually of metal or plastic, but sometimes of wood, sand, or the like.

It is to be understood that the invention is not to be limited to the exact details of construction, operation, or exact materials or embodiments shown and described, as obvious modifications and equivalents will be apparent to one skilled in the art, and the invention is therefore to be limited only by the full scope of the appended claims.

I claim:

1. A method for the surface finishing of a part or workpiece with loose particulate finishing material or media comprising the steps of providing a first body of finishing media, providing a second body of finishing media, said first body and said second body being in side-by-side or lateral juxtaposition with respect to each other, independently applying vibratory action to each of said first and second bodies of finishing media to impart relative motion thereto and to cause portions of said first and second bodies to impinge upon each other, and subjecting the part or workpiece to said finishing media for the surface finishing of said part or workpiece by the action of said finishing media.

2. The method of claim 1, wherein orbital motion is imparted to each of said bodies of finishing media.

3. The method of claim 2, wherein the orbital motion imparted to said bodies of finishing material is other than unidirectional.

4. The method of claim 3, wherein the orbital motion imparted to said first body of finishing media is a generally clockwise orbital motion and wherein the orbital motion imparted to said second body of finishing media is a generally counter-clockwise orbital motion.

5. The method of any of claims 1–4, wherein said part or workpiece is fixtured during subjection of said part or workpiece to said finishing media.

6. The method of any of claims 1–4, wherein said part or workpiece is passed through said finishing media.

7. The method of claim 4, wherein said part or workpiece is fixtured and subjected to the action of said finishing media in an area of convergence of said counter-clockwise and said clockwise orbital motions of said media.

8. A finishing machine, useful for the finishing of parts or workpieces therein by the action of loose or particulate finishing material or media therein, including a finishing chamber comprising two independent upwardly-extending finishing chamber walls, said walls being in apposed facing side-by-side or lateral relation with respect to each other, resilient means for resiliently associating said walls with each other at a bottom portion thereof, and vibratory means independently associated with each of said two finishing chamber walls for independently imparting vibratory motion thereto.

9. The finishing machine of claim 8, wherein said finishing chamber is resiliently supported for vibration.

10. The finishing machine of claim 9, wherein each of said upwardly-extending walls is essentially arcuate in cross-section.

11. The finishing machine of claim 10, wherein said arcuate cross-section is essentially that of a semi-circle or portion thereof.

12. The finishing machine of claim 10, wherein said vibratory means on each of said walls is variable to vary vibrations imparted to each of said walls and to loose or particulate finishing media within said finishing chamber.

13. The finishing machine of claim 10, wherein each of said walls defines a separate section of said finishing chamber, the two apposed walls defining two side-by-side juxtaposed sections of said finishing chamber, and wherein the vibratory means associated with each of said walls is adapted to impart vibrations to the section of said finishing chamber defined by the wall with which it is associated.

14. The finishing machine of claim 13, wherein said vibratory means is adapted to impart either unidirectional or other than unidirectional orbital motion to finishing media within said finishing chamber.

15. The finishing machine of claim 14, wherein said vibratory means is adapted to impart clockwise orbital motion to finishing media within said first section of said finishing chamber and counter-clockwise orbital motion to finishing media within said second section of said finishing chamber.

16. The finishing machine of claim 8, wherein said walls are resiliently connected with each other by connecting means at a bottom portion thereof.

17. The finishing machine of claim 16, wherein said connecting means is elastomeric.

18. The finishing machine of claim 8, also comprising an elastomeric lining on inner surfaces of the finishing chamber thereof.

19. The finishing machine of claim 18, wherein both said connecting means and said inner surface finishing chamber lining are elastomeric.

20. The finishing machine of claim 19, wherein said connecting means and said inner-surface lining provide an essentially integral elastomeric surface interior of said finishing chamber.

21. The finishing machine of claim 8, including also, in association therewith, fixture means for fixturing a part or workpiece within said finishing chamber for action thereupon of finishing media therein.

22. The finishing machine of claim 21, wherein said fixture means comprises a track and carriage means suspended therefrom for fixturing of parts or workpieces for passage through said finishing chamber for subjecting said part or workpiece to finishing media therein.

23. The finishing machine of claim 8, wherein a plurality of said finishing chamber units are connected linearly.

24. The finishing machine of claim 8, wherein said finishing machine comprises a plurality of individual finishing chamber units arcuately connected.

25. The finishing machine of claim 24, wherein said finishing machine comprises a plurality of individual finishing chamber units arcuately connected so as to form a circle.

26. The finishing machine of any of claims 23–25, wherein said plurality of individual finishing chamber units are independently mounted and resiliently connected.

27. The finishing machine of any of claims 8–20, wherein said walls and said associating resilient means cooperate to form not only resiliently-associated upwardly-extending walls but also the bottom of said finishing chamber.

28. A finishing machine for the finishing of parts or workpieces therein by the action of loose or particulate finishing material or media therein, including a finishing chamber comprising two independent finishing chamber sections in side-by-side or lateral juxtaposition, said sections being resiliently associated with each other at a bottom portion of said finishing chamber, and vibratory means independently associated with each of said two finishing chamber sections for independently imparting vibratory motion thereto.

29. A method for surface finishing a part or workpiece with loose particulate finishing material or media comprising the steps of providing a body of finishing media, applying vibratory action to said body of finishing media to impart relative motion thereto and to cause orbital motion to be imparted to said body of finishing media, fixturing said part or workpiece with relation to a particular peripheral upward or downward segment of said orbital motion, and subjecting said part or workpiece to said finishing media for the surface finishing of said part or workpiece, particularly at a surface portion thereof impinged upon by the said upward or downward action of said finishing media at said particular peripheral segment of said orbital flow, wherein two separate bodies of finishing media are provided in side-by-side or lateral juxtaposition and each is vibrated independently to produce orbital motion therein, said orbital motion in the said two bodies of finishing media being in the same direction or in different directions and selected from clockwise and counter-clockwise directions.

30. The method of claim 29, wherein the orbital motion imparted to both said bodies of finishing material is a clockwise orbital motion and wherein said part or workpiece is fixtured with respect to a downward segment of the orbital motion of one of said bodies for subjecting said part or workpiece to said finishing media essentially at a top portion thereof and with respect to an upward segment of the orbital motion of the other of said bodies of finishing material for subjecting said part or workpiece to said finishing media essentially at a bottom portion thereof.

31. The method of claim 29, wherein the orbital motion imparted to both said bodies of finishing material is a counter-clockwise orbital motion and wherein said part or workpiece is fixtured with respect to a downward segment of the orbital motion of one of said bodies for subjecting said part or workpiece to said finishing media essentially at a top portion thereof and with respect to an upward segment of the orbital motion of the other of said bodies of finishing material for subjecting said part or workpiece to said finishing media essentially at a bottom portion thereof.

32. The method of claim 29, wherein the orbital motion imparted to one of the bodies of finishing material is a clockwise orbital motion and wherein the orbital motion imparted to the other of the bodies of finishing material is a counterclockwise orbital motion and wherein said part or workpiece is fixtured with respect to an upward segment of one of the orbital motions and with respect to a downward segment of the other of said orbital motions for subjecting said part or workpiece to said finishing media essentially at either a top or a bottom portion thereof.

33. The method of any of claims 29–32, wherein two separate bodies of finishing media are provided in side-by-side or lateral juxtaposition and each is vibrated independently to produce orbital motion therein, said orbital motion in one of said two bodies being counterclockwise and in the other of said two bodies being clockwise, and subjecting said part or workpiece to said finishing media in approximately an area of confluence or convergence of said two orbital motions of said two bodies of finishing media.

* * * * *